US011772240B2

(12) United States Patent
Wen

(10) Patent No.: US 11,772,240 B2
(45) Date of Patent: Oct. 3, 2023

(54) PLIERS

(71) Applicant: Yuan-Hung Wen, Chang Hua County (TW)

(72) Inventor: Yuan-Hung Wen, Chang Hua County (TW)

( * ) Notice: Subject to any disclaimer, the term of this patent is extended or adjusted under 35 U.S.C. 154(b) by 304 days.

(21) Appl. No.: 17/030,558

(22) Filed: Sep. 24, 2020

(65) Prior Publication Data

US 2021/0122010 A1 Apr. 29, 2021

(30) Foreign Application Priority Data

Oct. 28, 2019 (TW) ..... 108138908

(51) Int. Cl.

| | |
|---|---|
| ***B25B 7/22*** | (2006.01) |
| ***B25B 27/14*** | (2006.01) |
| ***B25B 25/00*** | (2006.01) |
| *B25B 7/08* | (2006.01) |

(52) U.S. Cl.

CPC ..... *B25B 7/22* (2013.01); *B25B 25/005* (2013.01); *B25B 27/146* (2013.01); *B25B 7/08* (2013.01)

(58) Field of Classification Search

CPC .... B25B 7/22; B25B 7/08; B25B 7/04; B25B 25/005; B25B 27/146; B25B 27/0035; B25B 27/0071; B25B 27/00; H01R 43/045; B25F 1/003

USPC ..... 140/93.4; 29/219, 221, 223, 248, 278; 269/3, 6, 95

See application file for complete search history.

(56) References Cited

U.S. PATENT DOCUMENTS 2,777,345 A * 1/1957 Reider, Jr. ..... H01R 43/045 72/409.06
2,812,676 A * 11/1957 Brown ..... H01R 43/045 72/409.06
2,941,431 A * 6/1960 Christensen ..... A01K 95/02 29/243.57
5,307,553 A * 5/1994 Frohlich ..... H01R 43/045 29/751

(Continued)

FOREIGN PATENT DOCUMENTS

EP 2006962 A1 * 12/2008 ..... H01R 43/045

OTHER PUBLICATIONS

EP2006962 Translated Description (Year: 2008).*

*Primary Examiner* — Lee D Wilson
*Assistant Examiner* — Jacob Adam Montgomery
(74) *Attorney, Agent, or Firm* — Muncy, Geissler, Olds & Lowe, P.C.

(57) ABSTRACT

A pliers, configured to assemble an end cap to a vehicle cable, an end cap set including a plurality of end caps connected with one another, the pliers including: a main body and a connecting mechanism. The main body includes a first handling portion, a second handling portion and a receiving portion. The first handling portion is pivotally connected with the second handling portion. The first handling portion is movable relative to the second handling portion between a first position and a second position, and the receiving portion has a receiving space configured to receive the end cap set. The connecting mechanism is connected with the first handling portion and includes a cutting portion, a pressing portion and a feeding member. The cutting portion and the pressing portion correspond to the receiving space, and the feeding member is configured to move the end cap set.

9 Claims, 9 Drawing Sheets

(56) References Cited

U.S. PATENT DOCUMENTS

| | | | | |
|---|---|---|---|---|
| 5,611,138 | A * | 3/1997 | Krampe | H01R 43/05 140/121 |
| 5,623,762 | A * | 4/1997 | White | A61M 5/3213 29/280 |
| 2002/0033039 | A1 * | 3/2002 | Gautheret | H01R 43/045 72/409.04 |
| 2017/0112115 | A1 * | 4/2017 | Graham | A01K 95/02 |

* cited by examiner

PLIERS

BACKGROUND OF THE INVENTION

Field of the Invention

The present invention relates to a pliers.

Description of the Prior Art

Generally, after a bicycle cable (such as a brake cable or a gear cable) is assembled to a bicycle, an end of the bicycle cable will be sleeved by an end cap to prevent the end of the bicycle cable from becoming a fraying end and hurting a human body.

For assembling the end cap to the end of the bicycle cable, the end cap is held with fingers and sleeved on the end of the bicycle cable, and a pair of nippers is used to press the end cap so as to combine the end cap with the bicycle cable. However, the end cap is too small and inconvenient to be picked up in operation, and the operation of the pair of nippers is easy to interfere with the fingers holding the end cap, which is inconvenience for operation and is time-wasting.

The present invention is, therefore, arisen to obviate or at least mitigate the above-mentioned disadvantages.

SUMMARY OF THE INVENTION

The main object of the present invention is to provide a pliers which has a simple structure and is easy to assemble an end cap to a vehicle cable.

To achieve the above and other objects, the present invention provides a pliers, configured to assemble an end cap to a vehicle cable, an end cap set includes a plurality of end caps connected with one another, the pliers including: a main body and a connecting mechanism. The main body includes a first handling portion, a second handling portion and a receiving portion. The first handling portion is pivotally connected with the second handling portion, and the first handling portion is movable relative to the second handling portion between a first position and a second position. The receiving portion has a receiving space configured to receive the end cap set. The connecting mechanism is connected with the first handling portion and includes a cutting portion, a pressing portion and a feeding member. The cutting portion and the pressing portion correspond to the receiving space, and the feeding member is configured to move the end cap set.

The present invention will become more obvious from the following description when taken in connection with the accompanying drawings, which show, for purpose of illustrations only, the preferred embodiments) in accordance with the present invention.

DETAILED DESCRIPTION OF THE PREFERRED EMBODIMENTS

Figure 1:
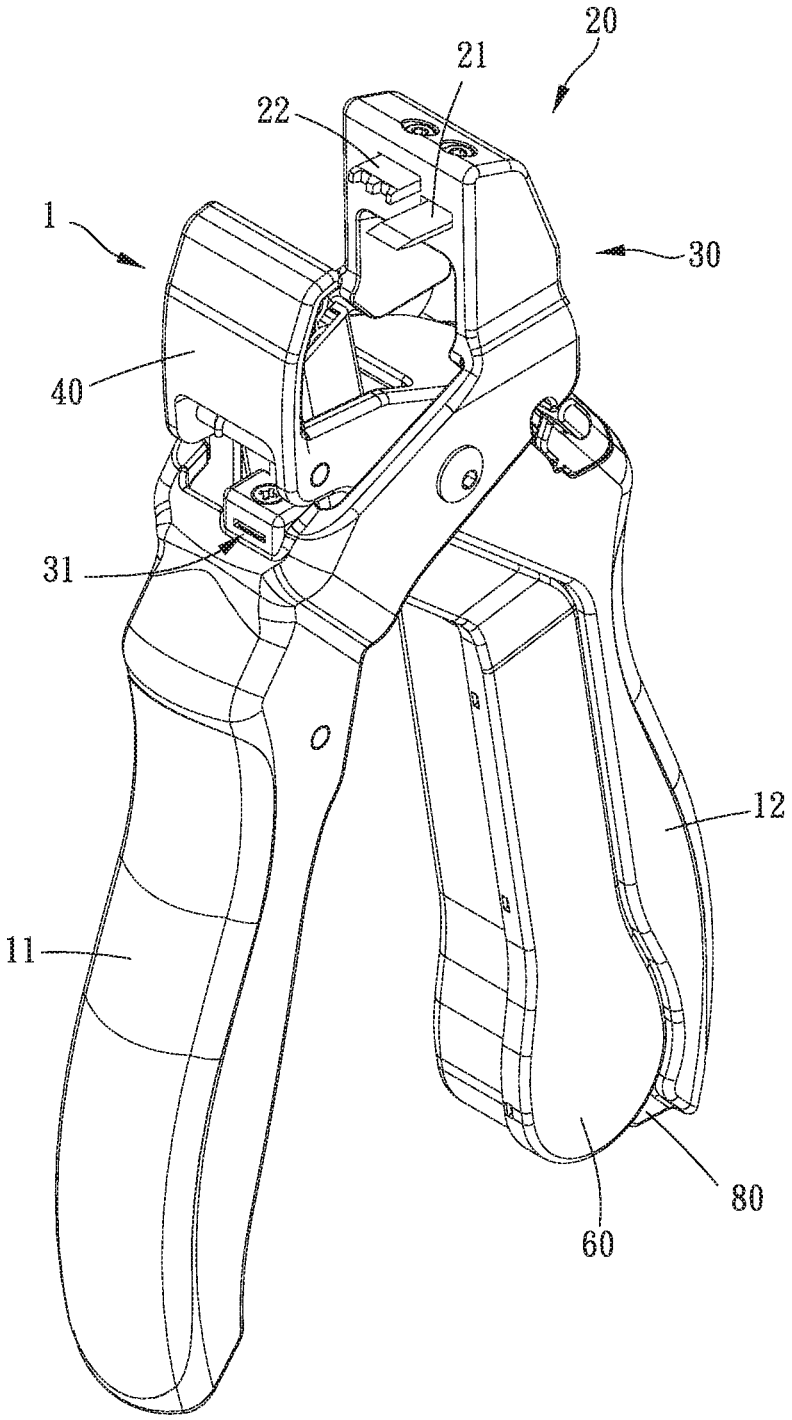
FIG. 1 is a stereogram of a preferable embodiment of the present invention.
Figure 2:
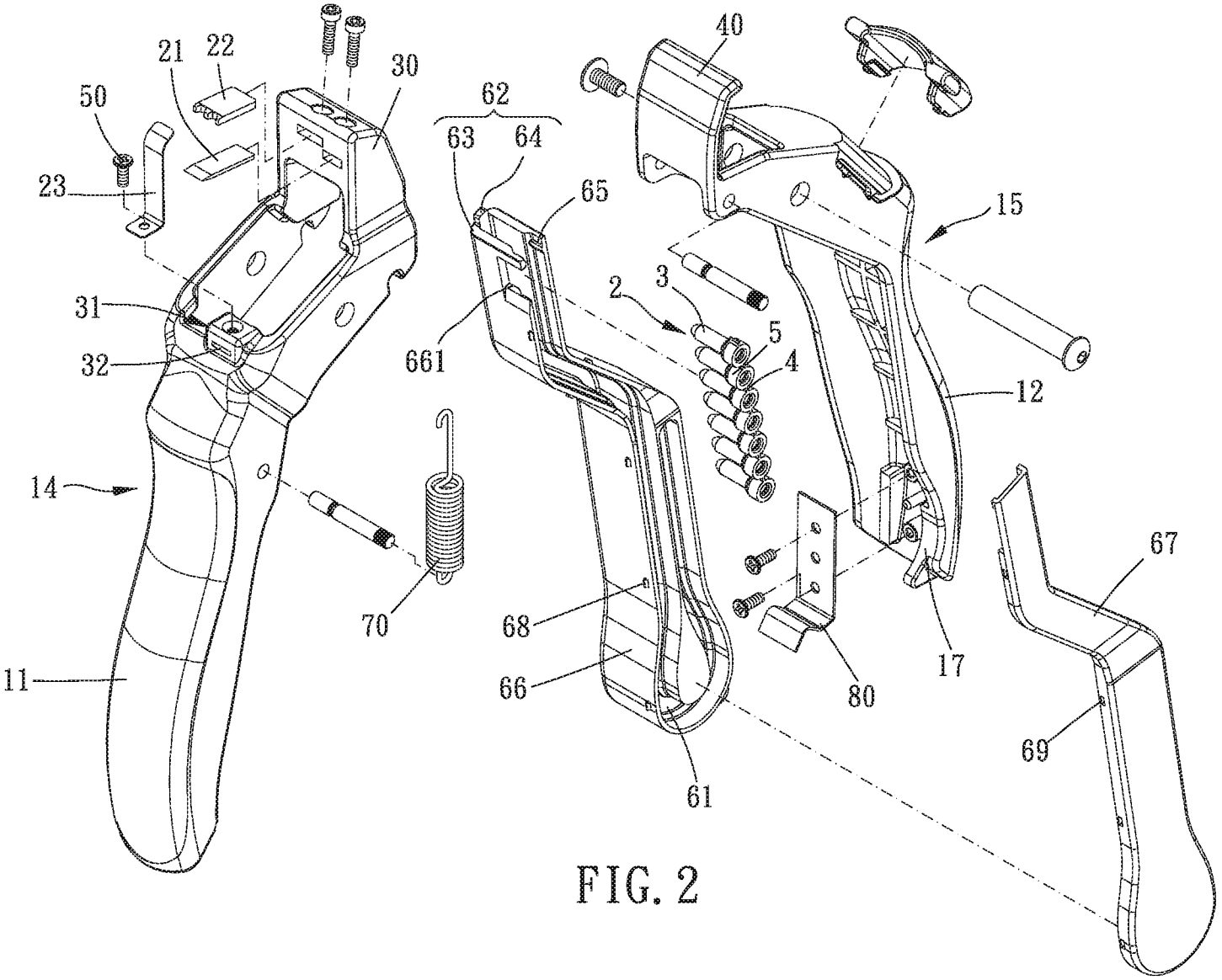
FIG. 2 is a breakdown drawing of a preferable embodiment of the present invention.
Figure 3:
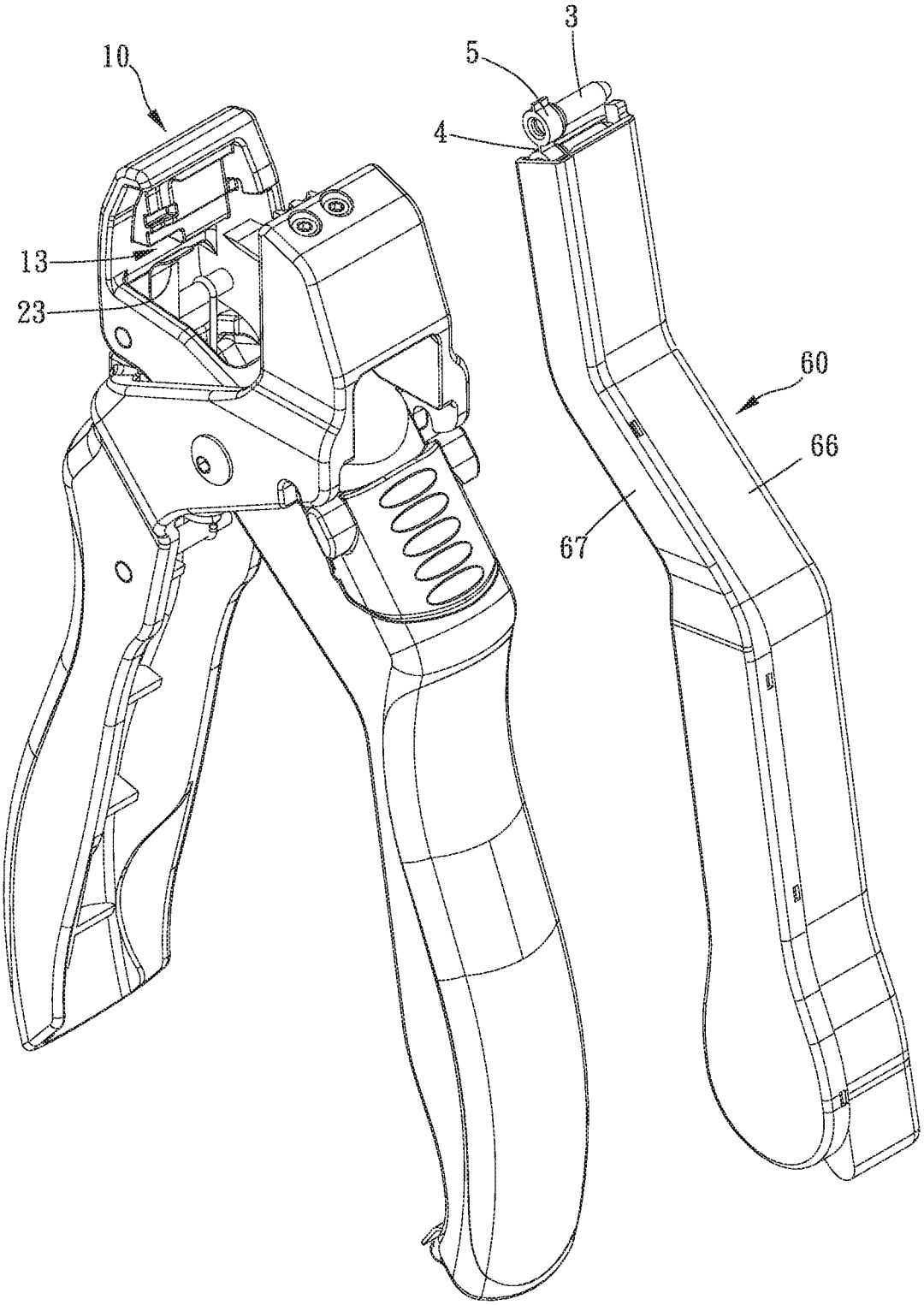
FIG. 3 is another breakdown drawing of a preferable embodiment of the present invention.

Please refer to FIGS. 1 to 10 for a preferable embodiment of the present invention. A pliers 1 of the present invention is configured to assemble an end cap 3 to a vehicle cable 6. An end cap set 2 includes a plurality of end caps 3 and a plurality of connecting segments 4, and adjacent two of the plurality of end caps 3 are connected by one of the plurality of connecting segments 4. The pliers 1 includes a main body 10 and a connecting mechanism 20. An aspect of the end cap set is not limited in this invention, and the plurality of connecting segments may be integrally connected to one another or be configured as other aspects.

Figure 4:
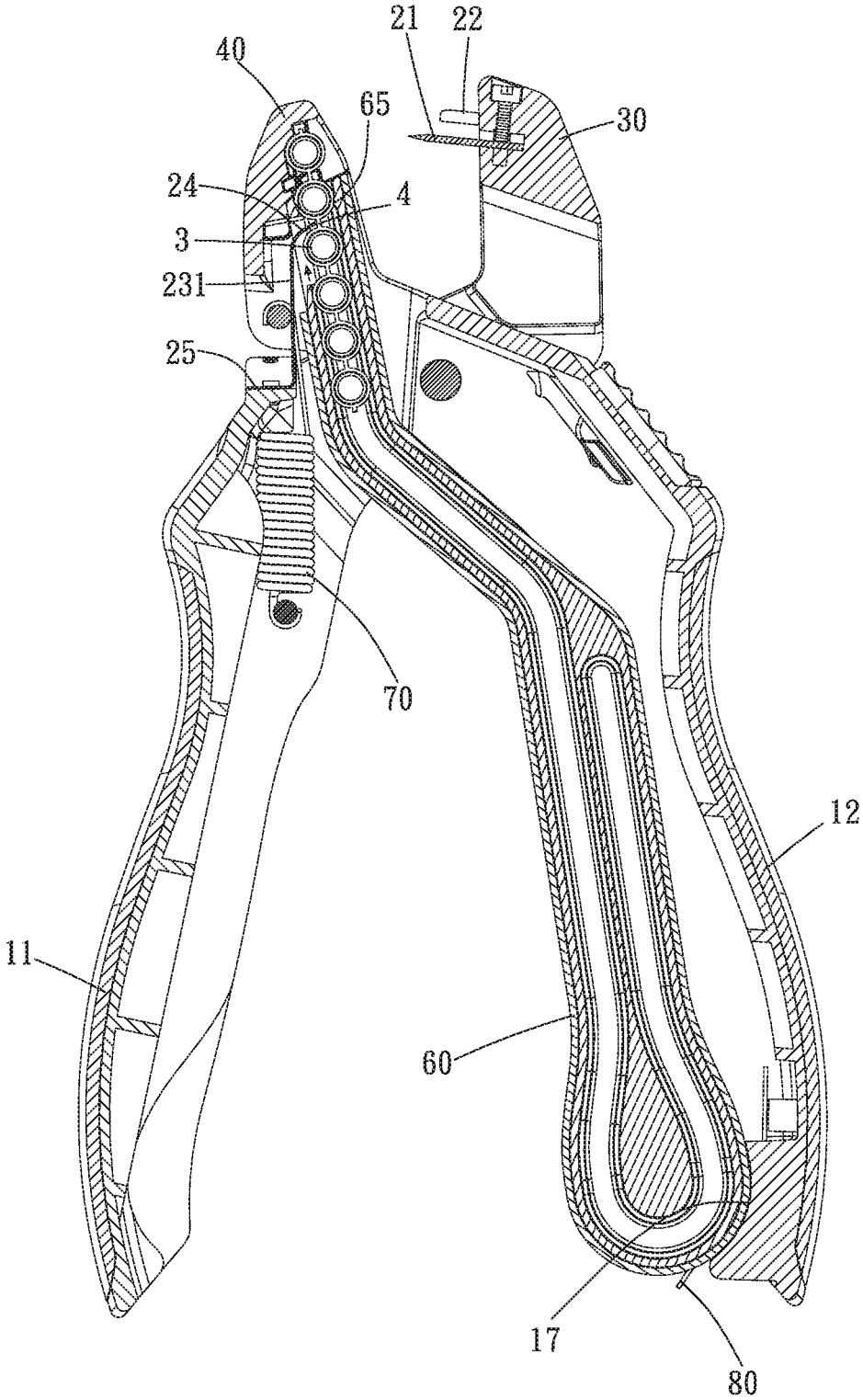
FIG. 4 is a cross-sectional view of a preferable embodiment of the present invention.
Figure 5:
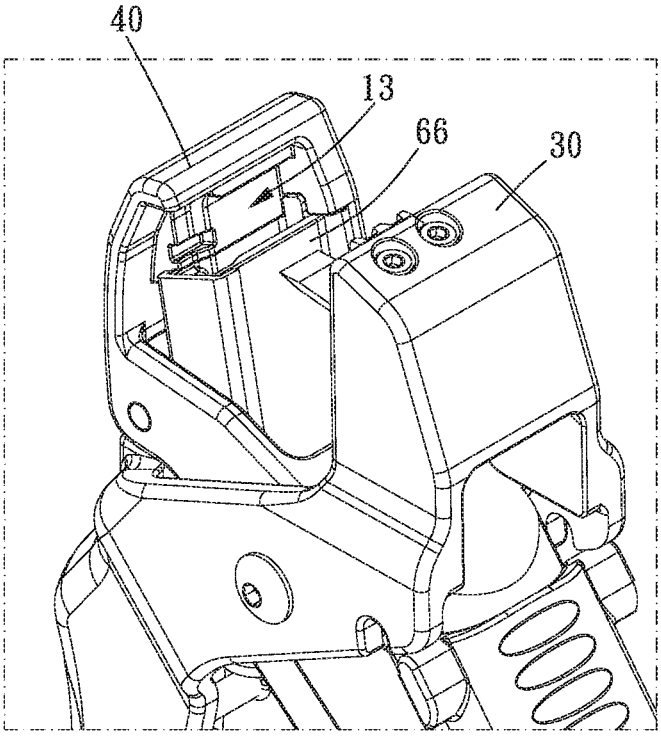
FIG. 5 is a partial enlargement of a preferable embodiment of the present invention.
Figure 6:
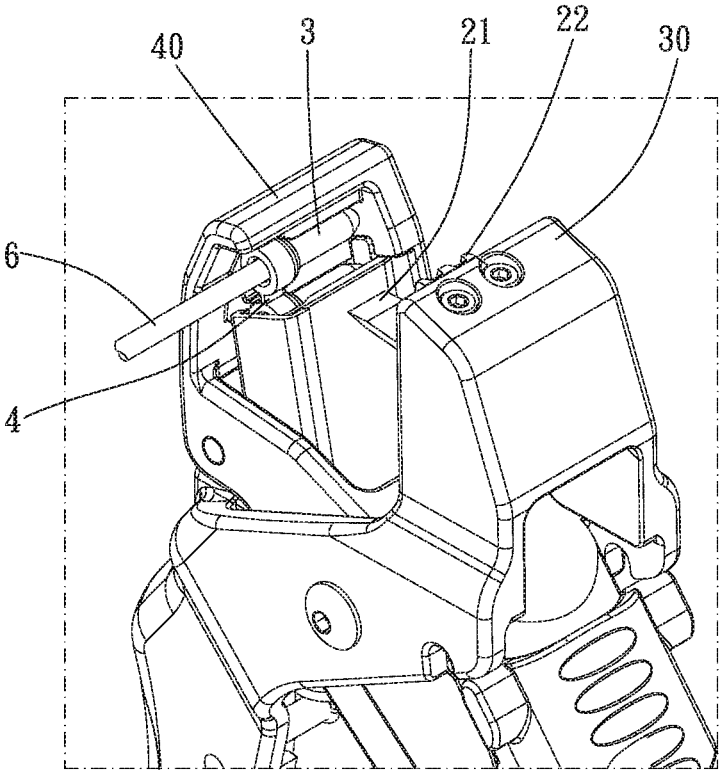
FIG. 6 is a partial enlargement showing operation of a preferable embodiment of the present invention.
Figure 7:
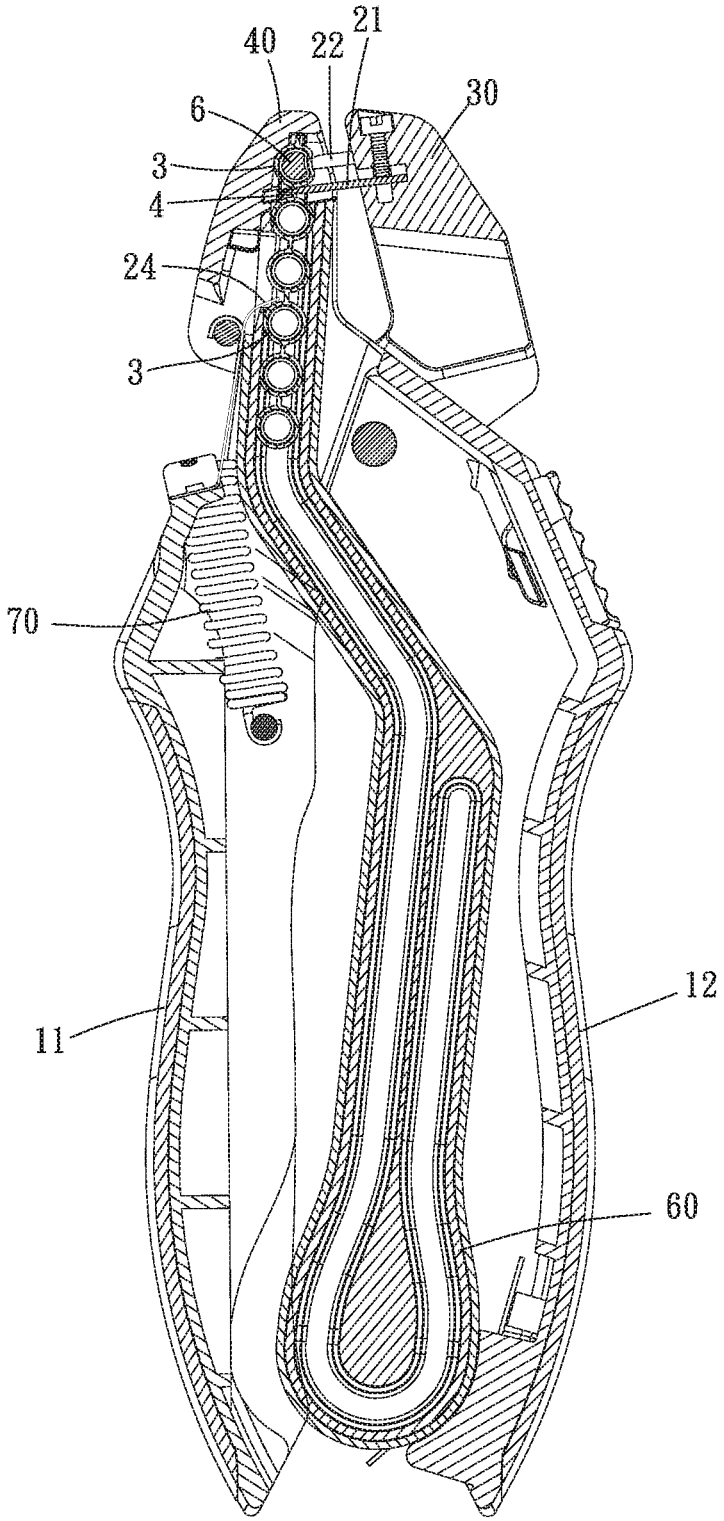
FIG. 7 is another cross-sectional view of a preferable embodiment of the present invention.
Figure 8:
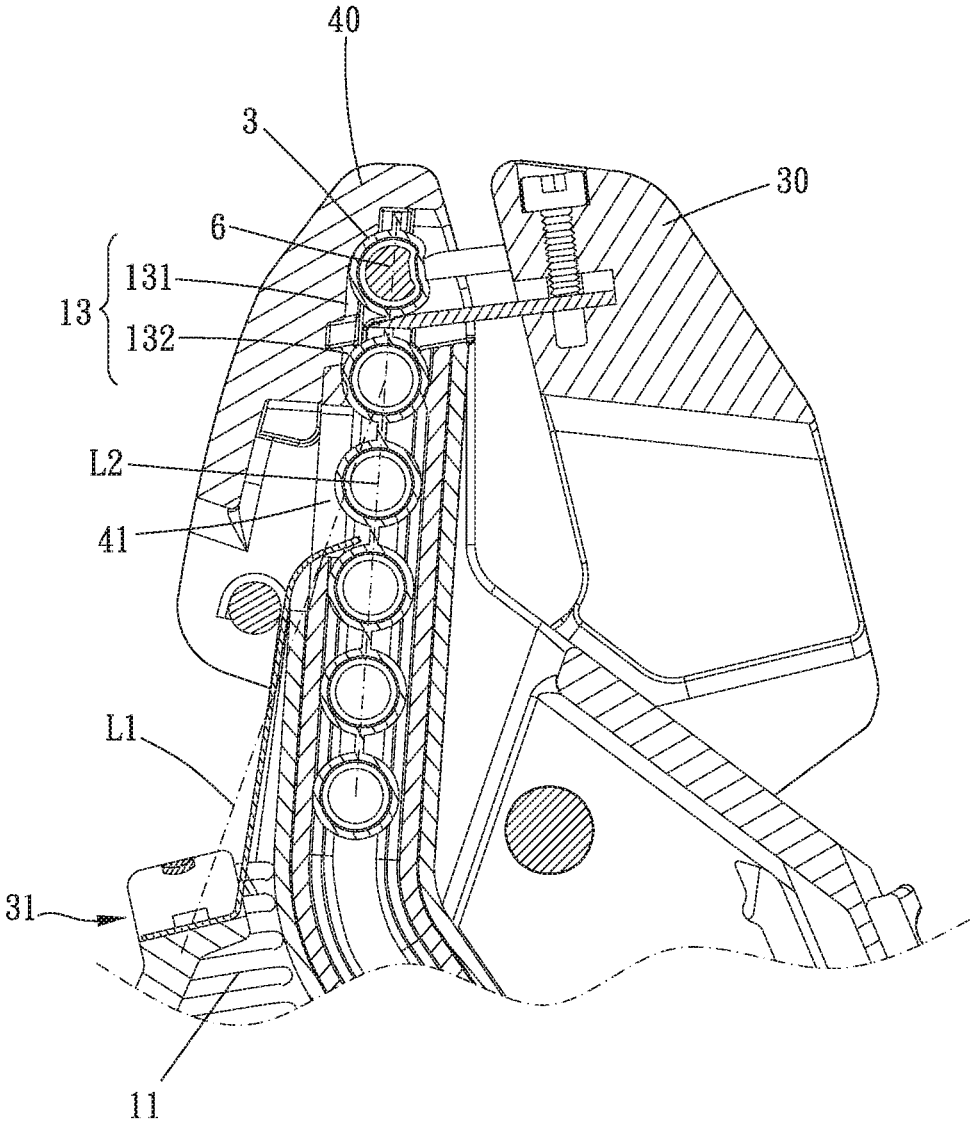
FIG. 8 is a partial enlargement of FIG. 7.
Figure 9:
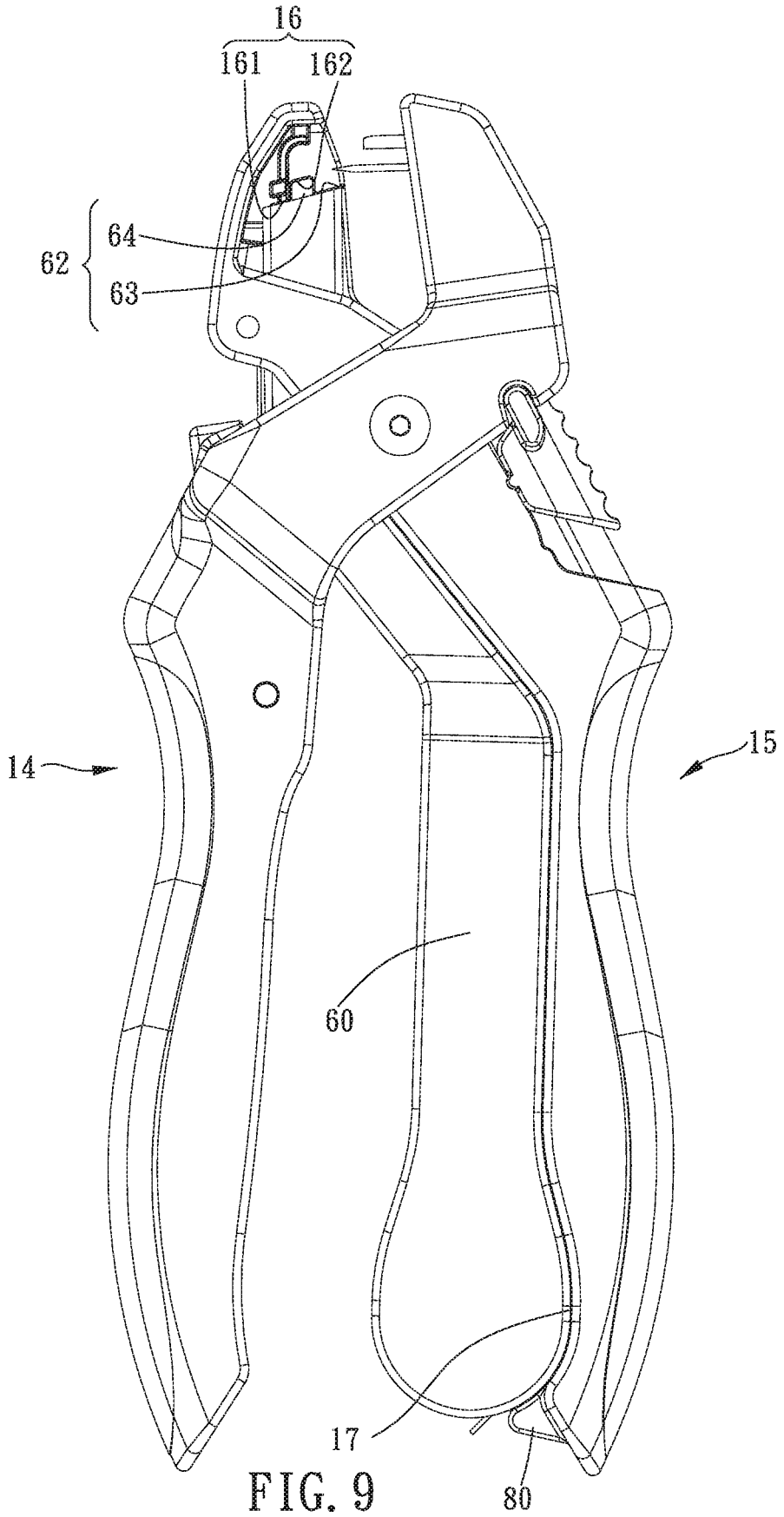
FIG. 9 is a front view of a preferable embodiment of the present invention.

The main body 10 includes a first handling portion 11, a second handling portion 12 and a receiving portion 13. The first handling portion 11 is pivotally connected with the second handling portion 12, and the first handling portion 11 is movable relative to the second handling portion 12 between a first position and a second position. In this embodiment, the first handling portion 11 and the second handling portion 12 are crossingly connected with each other and pivotable relative to each other. The receiving portion 13 has a receiving space 131 configured to receive the end cap set 2. The connecting mechanism 20 is connected with the first handling portion 11, and the connecting mechanism 20 includes a cutting portion 21, a pressing portion 22 and a feeding member 23. The cutting portion 21 and the pressing portion 22 correspond to the receiving space 131, and the feeding member 23 is configured to move the end cap set 2. The feeding member 23 is made of a elastically deformable material such as elastic plastic, metal or the like. When the first handling portion 11 is moved from the first position to the second position (in this embodiment, the first handling portion 11 and the second handling portion 12 are moved toward each other as shown in FIG. 7), the first handling portion 11 drives the cutting portion 21 to move toward the receiving portion 13 for cutting off one of the plurality of connecting segments 4 and drives the pressing portion 22 to move toward the receiving portion 13 for pressing one of the plurality of end caps 3, and the first handling portion 11 drives the feeding member 23 to move relative to the end cap set 2 in a direction away from the receiving space 131. When the first handling portion 11 is moved from the second position to the first position (in this embodiment, the first handling portion 11 and the second handling portion 12 are moved away from each other as shown in FIG. 4), the first handling portion 11 drives the cutting portion 21 and the pressing portion 22 to move away from the end cap set 2 and drives the feeding member 23 to move the end cap set 2 toward the receiving space 131. Therefore, the pliers 1 has a simple structure, and the cutting portion 21, the pressing portion 22 and the feeding member 23 are drivable to cut, press and move the end cap set 2 at the same time so as to quickly assemble one of the plurality of end caps 3 to the vehicle cable 6.

The feeding member 23 has a hooked portion 24 and a connecting portion 25, and the hooked portion 24 and the connecting portion 25 respectively pass through a hypothetical line L1. The receiving portion 13 has an entrance 132 which is communicated with the receiving space 131 and configured for the end cap set 2 to pass therethrough, and the hypothetical line L1 is transverse to an opening direction L2 of the entrance 132. The hooked portion 24 is configured to be biased against the end cap set 2. In this embodiment, the hooked portion 24 is configured to be biased against one of the plurality of connecting segments 4. Preferably, the feeding member 23 further has a bridge section 231, and the hooked portion 24 and the connecting portion 25 are respectively connected at two opposite sides of the bridge section 231 and extend backward relative to each other. The bridge section 231 is transverse to the hypothetical line L1 so that the feeding member 23 can keep biasing the end cap set 2. In this embodiment, when the first handling portion 11 is moved from the first position to the second position, the hooked portion 24 of the feeding member 23 is moved from one of the plurality of connecting segments 4 to another one of the plurality of connecting segment 4; when the first handling portion 11 is moved from the second position to the first position, the hooked portion 24 pushes next one of the plurality of end caps 3 and drives part of the end cap set 2 to move into the receiving space 131.

Figure 10:
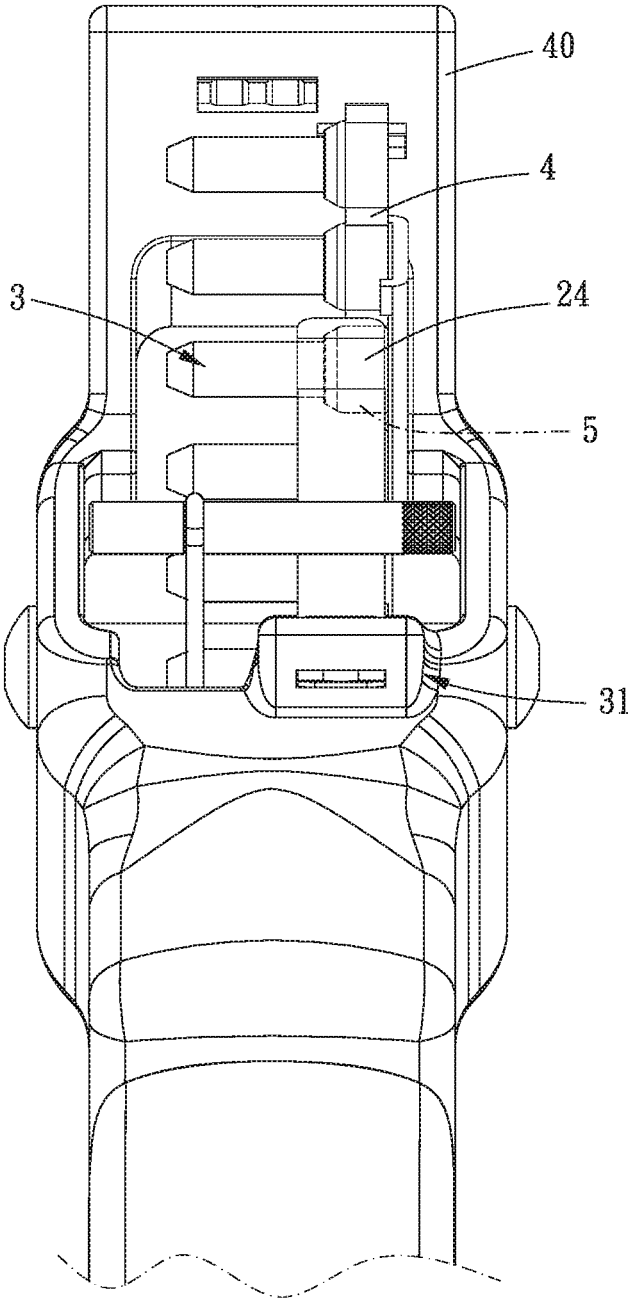
FIG. 10 is a schematic diagram of a preferable embodiment of the present invention in operation.

The feeding member 23 is configured to correspond to a plurality of large-diameter segments 5 of the plurality of end caps 3. Each of the plurality of end caps 3 has a largest outer diametrical dimension on its large-diameter segment 5, and the feeding member 23 is configured to be abutted against one of the plurality of the large-diameter segments 5. As viewed in a radial direction of one of the plurality of end caps 3 (as shown in FIG. 10), the feeding member 23 is configured to correspond ⅓ times an axial dimension of one of the plurality of end caps 3 so as to stably move the end cap set 2.

The main body 10 further includes a first clamping body 14 and a second clamping body 15. The first clamping body 14 includes the first handling portion 11 and a first jaw portion 30, and the second clamping body 15 includes the second handling portion 12 and a second jaw portion 40. The first clamping body 14 and the second clamping body 15 are pivotally connected with each other in a X-shaped configuration. The first jaw portion 30 is connected with the first handling portion 11, and the second jaw portion 40 is connected with the second handling portion 12. The first jaw portion 30 has the cutting portion 21 and the pressing portion 22. In this embodiment, the cutting portion 21 and the pressing portion 22 are respectively assembled to the first jaw portion 30 and protrude beyond the first jaw portion 30 so as to be laborsaving and have preferable pressing and cutting effects. The second jaw portion 40 has the receiving portion 13, and the feeding member 23 is immovably assembled to the first handling portion 11 and is not directly connected with the second handling portion 12. The second jaw portion 40 further includes a communicating space 41, and the communicating space 41 is communicated with the receiving space 131. The communicating space 41 is closer to the first handling portion 11 than the receiving space 131, and the communicating space 41 and the receiving space 131 are configured for the end cap set 2 to penetrate therewithin so as to have a simple structure. In this embodiment, the first handling portion 11 has a shoulder portion 31 which is exposed outwardly and adjacent to the second jaw portion 40, the communicating space 41 is open toward the shoulder portion 31, and the feeding member 23 is assembled to the shoulder portion 31 and protrudes into the communicating space 41, which is convenient to assemble/disassemble and the first handling portion 11 can directly drive the feeding member 23 to move. In this embodiment, the shoulder portion 31 has an insertion hole 32, and the feeding member 23 (the connecting portion 25 in this embodiment) is inserted within the insertion hole 32. A screwing member 50 penetrates within the feeding member 23 (the connecting portion 25 in this embodiment) and the insertion hole 32 and is screwed on the shoulder portion 31.

The pliers 1 further includes a cartridge 60, and the cartridge 60 is detachably assembled to the main body 10. The cartridge 60 includes a receiving groove 61 configured to receive the end cap set 2. The main body 10 has a first assembling structure 16 and a second assembling structure 17. The cartridge 60 has a connecting structure 62, and the cartridge 60 is engageably disposed between the first assembling structure 16 and the second assembling structure 17. The first assembling structure 16 and the connecting structure 62 are engaged with each other. Specifically, the first assembling structure 16 includes a first abutting surface 161 and an engaging concave 162 disposed on the first abutting surface 161, and the connecting structure 62 includes a second abutting surface 63 facing the first abutting surface 161 and an engaging convex 64 protruding beyond the second abutting surface 63. The first abutting surface 161 and the second abutting surface 63 are abuttable against each other, and the engaging convex 64 and the engaging concave 162 are engageable with each other. Preferably, the first assembling structure 16 is disposed on the second jaw portion 40, and the first assembling structure 16 and the connecting structure 62 are disposed along the opening direction L2 so that the cartridge 60 is stably positioned on the main body 10 and the end cap set 2 can be quickly assembled to or disassembled from the cartridge 60. Moreover, the main body 10 further has an elastic abutting member 80, and the elastic abutting member 80 has a plurality of bending segments which are flexible so as to be easy to elastically compress or restore. The elastic abutting member 80 is adjacent to the second assembling structure 17, and the elastic abutting member 80 is elastically abutted against the cartridge 60 so that the cartridge 60 is easy to disengage from the second assembling structure 17. In this embodiment, the second assembling structure 17 is an arcuate groove.

The cartridge 60 further has a protruding portion 65 extending toward the receiving groove 61, the protruding portion 65 and the feeding member 23 are respectively located at two opposite sides of the cartridge 60 and extend toward each other, and the protruding portion 65 is configured to be abutted against the end cap set 2 so as to block the end cap set 2 from moving. The cartridge 60 has a mouth 661 which is communicated with the receiving groove 61, and the feeding member 23 protrudes, through the mouth 661, into the receiving groove 61.

The cartridge 60 further includes a case 66 and a cover 67 detachably covering the case 66, and the case 66 and the cover 67 define the receiving groove 61. One of the case 66 and the cover 67 has a plurality of male connecting structures 68, and the other of the case 66 and the cover 67 has a plurality of female connecting structures 69. The plurality of male connecting structures 68 and the plurality of female connecting structures 69 are detachably connected with one another. In this embodiment, each of the plurality of male connecting structures 68 is disposed on the case 66 and is a projection, and each of the plurality of female connecting structures 69 is disposed on the cover 67 and is an engaging hole which is engageable with the projection.

The main body 10 further includes an extension spring 70, and the extension spring 70 is connected between the second jaw portion 40 and the first handling portion 11 so as to elastically return the first handling portion 11 to its original position.

In operation, the vehicle cable 6 is inserted into one of the plurality of end caps 3, and the first handling portion 11 drives the pressing portion 22 to press and deform one of the plurality of end caps 3, and drives the cutting portion 21 to cut off the connecting segment, and the feeding member 23 is moved to push next one of the plurality of end caps 3 so as to quickly assemble one of the plurality of end caps 3 to the vehicle cable 6 and have preferable operation efficiency.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pliers, configured to assemble an end cap to a vehicle cable, an end cap set including a plurality of end caps connected with one another, the pliers including:

a main body, including a first handling portion, a second handling portion and a receiving portion, the first handling portion being pivotally connected with the second handling portion, the first handling portion being movable relative to the second handling portion between a first position and a second position, the receiving portion having a receiving space configured to receive the end cap set;

a connecting mechanism, being connected with the first handling portion, including a cutting portion, a pressing portion and a feeding member, the cutting portion and the pressing portion corresponding to the receiving space, the feeding member being configured to move the end cap set;

wherein the main body further includes a first clamping body and a second clamping body which are pivotally connected with each other in an X-shaped configuration, the first clamping body includes the first handling portion and the second clamping body includes the second handling portion, the feeding member is immovably assembled to the first handling portion, and the receiving portion is disposed on the second clamping body;

wherein the main body further includes a first jaw portion and a second jaw portion, the first jaw portion is connected with the first handling portion, the second jaw portion is connected with the second handling portion, the first jaw portion has the cutting portion and the pressing portion, the second jaw portion has the receiving portion, the second jaw portion further includes a communicating space, the communicating space is communicated with the receiving space, the communicating space is closer to the first handling portion than the receiving space, the communicating space and the receiving space are configured for the end cap set to penetrate therewithin.

2. The pliers of claim 1, wherein when the first handling portion is moved from the first position to the second position, the first handling portion drives the cutting portion and the pressing portion to move toward the receiving portion, the pressing portion is configured to press one of the plurality of end caps, and the first handling portion drives the feeding member to move relative to the end cap set; when the first handling portion is moved from the second position to the first position, the first handling portion drives the feeding member to move the end cap set.

3. The pliers of claim 1, wherein the feeding member has a hooked portion and a connecting portion, the hooked portion and the connecting portion respectively pass through a hypothetical line, the hooked portion is configured to be biased against the end cap set, the receiving portion has an entrance which is communicated with the receiving space and configured for the end cap set to pass therethrough, and the hypothetical line is transverse to an opening direction of the entrance.

4. The pliers of claim 3, wherein the feeding member further has a bridge section, the hooked portion and the connecting portion are respectively connected at two opposite sides of the bridge section and extend backward relative to each other.

5. The pliers of claim 1, wherein the first handling portion has a shoulder portion which is exposed outwardly and adjacent to the second jaw portion, the communicating space is open toward the shoulder portion, and the feeding member is assembled to the shoulder portion and protrudes into the communicating space.

6. The pliers of claim 5, wherein the pliers further includes a cartridge, the cartridge is detachably assembled to the main body, the cartridge includes a receiving groove configured to receive the end cap set, the main body has a first assembling structure and a second assembling structure, the cartridge has a connecting structure, the cartridge is engageably disposed between the first assembling structure and the second assembling structure, the first assembling structure and the connecting structure are engaged with each other; as viewed in a radial direction of one of the plurality of end caps, a width of the feeding member corresponds ⅓ times a width of the cartridge; the first assembling structure includes a first abutting surface and an engaging concave disposed on the first abutting surface, the connecting structure includes a second abutting surface facing the first abutting surface and an engaging convex protruding beyond the second abutting surface, the first abutting surface and the second abutting surface are abuttable against each other, the engaging convex and the engaging concave are engageable within each other; the cartridge further has a protruding portion extending toward the receiving groove, the protruding portion and the feeding member are respectively located at two opposite sides of the cartridge and extend toward each other; the receiving portion has an entrance which is communicated with the receiving space and configured for the end cap set to pass therethrough; the first assembling structure is disposed on the second jaw portion, the first assembling structure and the connecting structure are disposed along an opening direction of the entrance; the cartridge further includes a case and a cover detachably covering the case, the case and the cover define the receiving groove, one of the case and the cover has a plurality of male connecting structures, the other of the case and the cover has a plurality of female connecting structures, the plurality of male connecting structures and the plurality of female connecting structures are detachably connected with one another; each of the plurality of male connecting structures is a projection, each of the plurality of female connecting structures is an engaging hole which is engageable with the projection; the main body further includes an extension spring, the extension spring is connected between the second jaw portion and the first handling portion; the shoulder portion has an insertion hole, the feeding member is inserted within the insertion hole, and a screwing member penetrates within the feeding member and the insertion hole and is screwed on the shoulder portion; the main body further includes an elastic abutting member, the elastic abutting member has a plurality of bending segments which are flexible; the elastic abutting member is adjacent to the second assembling structure, the elastic abutting member is elastically abutted against the cartridge; the feeding member is configured to correspond to a plurality of large-diameter segments of the plurality of end caps, each of the plurality of end caps has a largest outer diametrical dimension on said large-diameter segment, the feeding member is configured to be abutted against one of the plurality of large-diameter segments.

7. A pliers, configured to assemble an end cap to a vehicle cable, an end cap set including a plurality of end caps connected with one another, the pliers including:

a main body, including a first handling portion, a second handling portion and a receiving portion, the first handling portion being pivotally connected with the second handling portion, the first handling portion being movable relative to the second handling portion between a first position and a second position, the receiving portion having a receiving space configured to receive the end cap set;

a connecting mechanism, being connected with the first handling portion, including a cutting portion, a pressing portion and a feeding member, the cutting portion and the pressing portion corresponding to the receiving space, the feeding member being configured to move the end cap set;

wherein the main body further includes a first clamping body and a second clamping body which are pivotally connected with each other in an X-shaped configuration, the first clamping body includes the first handling portion and the second clamping body includes the second handling portion, the feeding member is immovably assembled to the first handling portion, and the receiving portion is disposed on the second clamping body;

wherein the pliers further includes a cartridge, the cartridge is detachably assembled to the main body, the cartridge includes a receiving groove configured to receive the end cap set, the main body has a first assembling structure and a second assembling structure, the cartridge has a connecting structure, the cartridge is engageably disposed between the first assembling structure and the second assembling structure, and the first assembling structure and the connecting structure are engaged with each other.

8. The pliers of claim 7, wherein the first assembling structure includes a first abutting surface and an engaging concave disposed on the first abutting surface, the connecting structure includes a second abutting surface facing the first abutting surface and an engaging convex protruding beyond the second abutting surface, the first abutting surface and the second abutting surface are abuttable against each other, and the engaging convex and the engaging concave are engageable with each other.

9. The pliers of claim 7, wherein the cartridge further has a protruding portion extending toward the receiving groove, the protruding portion and the feeding member are respectively located at two opposite sides of the cartridge and extend toward each other, and the protruding portion is configured to be abutted against the end cap set.

* * * * *